United States Patent [19]

Arnhold

[11] 4,001,743

[45] Jan. 4, 1977

[54] HEAVY DUTY AUTOMATIC CIRCUIT BREAKER

[75] Inventor: Hans Arnhold, Kaelberau, Germany

[73] Assignee: Firma Heinrich Kopp, Inhaber Theodor Simoneit, Kahl (Main), Germany

[22] Filed: May 8, 1975

[21] Appl. No.: 575,642

[30] Foreign Application Priority Data

May 14, 1974 Germany ..... 2423207
Feb. 6, 1975 Germany ..... 2504954

[52] U.S. Cl. ..... 335/201; 200/144 R
[51] Int. Cl.² ..... H01H 9/30
[58] Field of Search ..... 335/201, 42; 200/144 R

[56] References Cited

UNITED STATES PATENTS 2,656,432 10/1953 Gano et al. ..... 335/42
3,691,489 9/1972 Knirsch et al. ..... 335/201
3,790,911 2/1974 Kick et al. ..... 335/201

*Primary Examiner*—Harold Broome
*Attorney, Agent, or Firm*—W. G. Fasse; W. W. Roberts

[57] ABSTRACT

The present heavy duty automatic circuit breaker is compact in construction, since all elements are coordinated to each other in an efficient manner. Thus, an upper arc guide plate of a quenching stack is extended to form the stationary contact member. The movable contact member is a single arm pivot contact arranged directly in front of said quenching stack. A lower arc guide plate of the quenching stack is extended and electrically connected to the movable contact member. The circuit breaker includes means for either manual or automatic circuit breaking, the latter in response to overload and/or excess temperature conditions.

15 Claims, 2 Drawing Figures

HEAVY DUTY AUTOMATIC CIRCUIT BREAKER

BACKGROUND OF THE INVENTION:

The invention relates to an electric automatic circuit breaker including a mechanic spring mechanism for the actuation of circuit breaker contact means. The contact means are arranged in an arc chamber in front of the facing end of a quenching sheet metal stack. The contact means are freely releasable either manually, electromagnetically or by thermo-electric means. The term "releasable" as used herein means the breaking or opening of a contact. Such circuit breakers are employed especially in connection with small installation circuits. It is one purpose of such circuit breakers to reduce as much as possible the mechanic circuit breaking delay in response to a short circuit or in response to a line overloading which will cause the circuit breaker release with sufficient speed to induce an arc voltage in the short circuit loop. Such arc voltage should be as high as possible for limiting the short circuit current in its size and effect.

Another purpose of these automatic circuit breakers is to quickly and completely quench the arc, which is generated across the electric contact break distance during the contact separation under load. Such arc carries a rather strong current, the rapid and complete quenching of which is essential if the automatic circuit breaker shall remain operational. Conventionally, this is achieved substantially by permitting the arc column emanating from the contact device of the circuit breaker to impinge with a high propagating speed upon the front face of a quenching sheet metal stack, whereby the arc column is divided into a number of partial arcs. A sufficient cooling and de-ionization of the arc gases is accomplished in this manner. These gases simultaneously escape through pressure equalization channels and the like, whereby the gases contribute to an instantaneous quenching of the circuit opening arc.

Prior art devices of this type employ for this purpose exclusively a contact device arranged in the space adjacent to or in front of the quenching sheet metal stack. A contact member constructed either as a bridge contact or as a pivoting contact is arranged to lift off from a fixed contact arranged opposite the movable contact member for opening the circuit across the contact break distance extending in parallel to the individual sheet metal strips of the quenching stack. In order to facilitate the entering of the resulting arc into the quenching sheet metal stack, it is necessary to directly extend the fixed contact by means of an additional guide rail to a guide plate of the quenching stack. Further, the movable contact member must be provided with a special run-off prong for the arc. In such an arrangement it is unavoidable that the arc running off the contact device must jump in any event from the movable contact member to the respective guide plate of the quenching stack in order to enter into the quenching stack. Such jumping not only impedes a continuous run-off of the switching arc it also opposes the arc stability and slows down the propagation speed of the arc whereby the entire arc quenching is substantially prolonged.

Furthermore, prior art automatic circuit breaker constructions of the mentioned type employ exclusively relatively complicated as well as bulky switching means, whereby it becomes impossible to reduce the available dimensions in the range of higher arc interrupting ratings. This is especially disadvantageous, if one intends to house as many automatic circuit breakers as possible in the usually limited space for this purpose, for more selectively monitoring the circuits of an installation.

OBJECTS OF THE INVENTION:

In view of the above it is the aim of the invention to achieve the following objects singly or in combination:

to construct a compact circuit breaker with a reduced arc quenching time;

to construct the electrical contact break distance in such a manner that the circuit opening arc occurring as a result of the breaking of a contact may pass unimpededly into the quenching sheet metal stack thereby to avoid an arc jumping and the resulting time delay;

to construct the circuit breaker contact means in such a manner that a rapid contact separation is assured under all operating conditions;

to reduce the total number of elements or parts required for a circuit breaker of this type;

to construct the spring actuating mechanism for the contact separation in such a manner that its force is instantaneously available as a contact separation force, whereby the coaction between the spring mechanism and the movable contact member must be such that it opposes any contact fusing;

to arrange the arc quenching means in such a manner that a high arc voltage is produced to thereby limit the arc current;

to provide an automatic circuit breaker spring mechanism which is as simple as possible and requires but little space, and by means of which it is possible to open the respective contact break distance at high speed at the instant of the triggering in order to cause the high current arc to instantaneously run-off of the contact point into the quenching device; and to provide a circuit breaker having a substantially higher switch-off capacity as compared to conventional circuit breakers having the same dimensions or to substantially reduce the dimensions of such circuit breakers while at the same time providing switch-off capacities comparable to those of conventional circuit breakers of larger dimensions.

SUMMARY OF THE INVENTION:

According to the invention there is provided a heavy duty automatic circuit breaker having a movable contact member constructed as a single arm pivot contact and arranged directly in front of the facing side or end of a quenching sheet metal stack, whereby the lower guide plate of the stack is arranged to function as the pivot or bearing point for the pivot contact member and whereby the upper guide plate is formed to function as the fixed contact member.

This arrangement of the invention assures in an advantageous manner that the switching arc occurring due to the opening of the contact break distance travels with its base along the pivot contact until it reaches its pivot point at the lower guide plate. Thereafter, the arc enters into the quenching sheet metal stack at the front face thereof and from both guide plates. Thus, the pivot contact functions as if it were an extension of the guide plate which is conductively connected to the pivot contact through the pivot point or bearing. This has the advantage that a jump-off point for the running-off arc has been avoided. Accordingly, the switching arc remains in continued contact with the two guide plates of the quenching device according to the invention starting from the instant of its ignition all the way to the end of the quenching sheet metal stack.

The heavy duty automatic circuit breaker according to the invention is further constructed in such a manner that a pair of levers tiltable about a common pivot axis and partially reaching into each other, is centrally arranged between the single arm pivot contact of the electrical circuit breaker means and the actuating handle of the mechanical spring mechanism. The pair of levers comprises a double arm cocking lever, one arm or leg of which is loosely coupled with the actuating handle by means of a wire bail. Said one arm of the cocking lever is also coupled, in a force locking manner, with the pivot contact by means of a compression spring. The other leg or arm of the cocking lever is arranged to become instantaneously effective on the pivot contact in response to release operation. The device further comprises a double arm release lever, one leg of which is arranged for cooperation with an electromagnetic release mechanism or with a thermoelectric release member, such as a bi-metal strip. The other leg of the release lever comprises a latching means for the wire bail of the actuating handle. This arrangement has the advantage that the mechanically operative connection between the switch-on and the release members on the one hand as well as the electrical circuit breaker means on the other hand is accomplished by one and the same lever combination, which is centrally arranged and which is connected with all the other elements either directly or by means of simple intermediate members. In this manner it is possible to substantially reduce the total number of required individual elements whereby simultaneously the elements or parts are simplified in their construction. Thus, according to the invention there is provided a mechanism which may be integrated in the least possible space with the structure of an automatic circuit breaker. In addition, the present spring mechanism achieves an extraordinarily advantageous time between the time of triggering and the then following contact breaking. This short time is due to the fact that few functional elements are employed and those used are centrally located whereby short translation distances result. This in turn makes possible a rapid run-off of the switching arc from the contact points into the quenching mechanism whereby a correspondingly high breaking capacity of the entire arrangement is achieved.

BRIEF FIGURE DESCRIPTION:

In order that the invention may be more clearly understood, it will now be described, by way of example, with reference to the accompanying drawings, wherein:

FIG. 1 shows a plan view of the circuit breaker according to the invention with the cover forming one of the two main walls of the housing removed and with the contact members shown in the circuit interrupting position; and FIG. 2 shows substantially the same features as FIG. 1 except that the contact members are now shown in their circuit closing position.

DETAILED DESCRIPTION OF EXAMPLE EMBODIMENTS:

Figure 1:
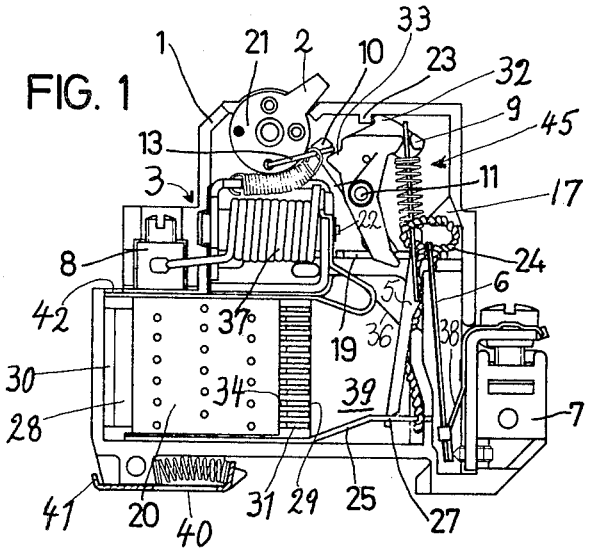
Figure 2:
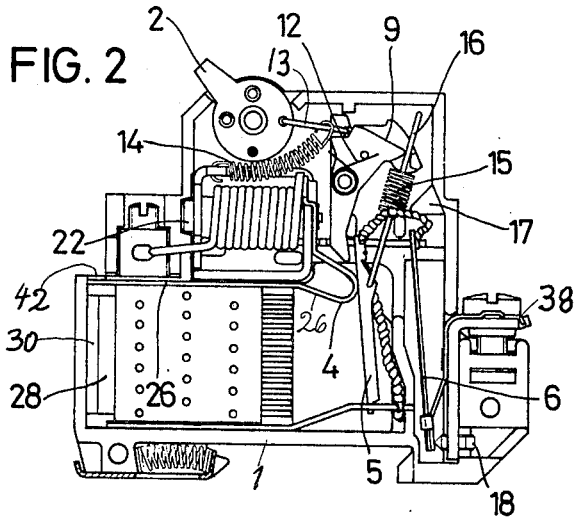

The drawings illustrate an embodiment of a compact, heavy duty automatic circuit breaker substantially in its natural size. In FIG. 1 the circuit breaker is switched off, in FIG. 2 it is switched on. The individual reference symbols for the same elements are used in one or both figures.

The spring mechanism 45 to be described in more detail below is located in the upper right-hand corner of a relatively flat insulating housing 1. The spring mechanism 45 may be actuated by the actuating handle 2, also located in the upper portion of the housing. An electromagnetic release means 3 is located in the upper left-hand portion of the housing. The arc quenching device 20 is located substantially in the lower left portion of the housing 1 to face with its front end 29 the circuit breaker means, which comprises a prong shaped protruding stationary contact 4 and a movable pivot contact 5 are arranged in front of the quenching device 20. To the right of and adjacent to the pivot contact 5 there is arranged a thermo-electric release means comprising a bi-metal strip 6 electrically connected through a flexible strand wire 24 with the single arm pivot contact 5. The bi-metal strip 6 is also electrically connected through said flexible strand wire 24 with the lower guide plate 25 of the quenching device 20. The bi-metal strip is further electrically connected in a fixed manner with a connector terminal 7 of the automatic circuit breaker whereby said terminal is located on the outside of said housing 1. A further connector terminal 8 is located on the opposite narrow side of of the housing 1. The further connector terminal 8 is electrically connected with the energizing coil 37 of the electromagnetic release means 3 and through said coil with the prong shaped fixed contact 4 of the circuit breaker means.

A prominent feature of the spring mechanism 45 according to the invention comprises the double arm cocking lever 9 and the double arm release or unlatching lever 10. Both levers 9 and 10 are journaled centrally in the mechanism for tilting about a common journal axis 11. In addition, one lever reaches into a recess of the other lever, whereby the inner wall of the recess provides a stop for the effect of a cocking spring 12.

The circuit breaker is switched on by means of the handle 2, the motion of which is transmitted by the wire bail 13 which forms a toggle lever and one end of which is supported in the lower round end 21 of the handle 2. A tension spring 14 partially loops around the surface of the lower round end 21 of the handle 2. The tension spring 14 pulls the wire bail 13 downwardly against said pair of levers 9 and 10. In this manner the wire bail 13, the other end of which is latched to the release lever 10, rests on a slant of the cocking lever 9 during the switching on movement, whereby the bail 13 tilts the pivot contact 5 against the fixed contact 4 of the circuit breaker means since the pivot contact 5 is coupled to the cocking lever 9 by means of a strong, helical compression spring 15 and by means of guide bail 16 of the compression spring 15. During this tilting, the guide bail 16 of the compression spring 15 prevents the latter from laterally yielding in the direction of the two levers 9 and 10. The guide bail 16 is journaled to the pivot contact 5 adjacent to the contact area proper of the pivot contact 5. The guide bail 16 extends centrally through the compression spring 15 and glides with its upper free end in a groove of the cocking lever 9.

A boss 17 formed on the inside wall of the housing 1 adjacent to the compression spring 15 causes an instantaneous tilting or tipping of the compression spring 15 about its central axis at a particular point of time in the course of the spring movement. As a result, the contacts close instantaneously whereupon the cocked compression spring 15 maintains the necessary contact pressure. Simultaneously, the lower leg or arm of the release lever 10 is tilted during the switching on movement into a position directly in front of the striking armature 22 of the electromagnetic release means 3. In this position, the lower leg of the release lever 10 is under the influence of the wire bail 13 of the handle 2 and the bail in turn is under the pressure of the springs 12 and 15 which maintain the bail in a latching engagement with the release lever 10, which is thus prepared for the several release operations.

The release operations of the automatic circuit breaker may be accomplished either by the actuation of the handle 2 or by the electromagnetic release means 3 in response to a short circuit in the power supply network, or by means of the thermo-electric bi-metal release strip 6 in response to an overload in the circuit. If the release operation is the result of a short circuit, the armature 22, which is influenced by the energizing coil 37 of the electromagnetic release means 3, hits with full force the leg of the release lever 10 located in front of the strike armature 22. Hence, the other end of the release lever 10, which is formed as a latch releases the wire bails 13, whereupon the bail 13 slides off the slant 33 of the cocking lever 9, thereby releasing the latching. In this operation, the striking armature 22 imparts an impact acceleration to the single arm pivot contact 5 in such an advantageous manner that the pivot contact 5 has a high initial speed whereby it reaches within fractions of a second the spacing from the fixed contact 4 necessary for the high current arc to run off the circuit breaker contacts. The unlatching simultaneously releases the helical compression spring 15 which permits the cocking lever 9 to be effective on the pivot contact 5 in the counterclockwise direction. This last mentioned operation takes also place instantaneously whereby the pivot contact 5 is further rapidly removed from the fixed contact 4 until the cocking lever 9 reaches its end position by running with its nose 32 against the stop 23 protruding from the inner wall of the housing 1. In this manner, the toggle joint formed by the cocking lever 9, the guide bail 16 and the pivot contact 5 is stretched so that the helical compression spring 15 again returns the pivot contact 5 into its starting position. The tension spring 14 simultaneously returns the wire bail 13 into latching engagement with the release lever 10 whereby the actuating handle 2 is also returned in the starting position and the circuit breaker is now again ready to be switched on.

The bi-metal strip 6 is mechanically coupled to the lower leg of the release lever 10 by means of a slide bail 19 to provide for a thermo-electric release. Said lower leg of the release lever 10 is the same as that described above and on which the striking armature 22 of the electromagnetic release means 3 is effective. The slide bail 19 is guided by a respective ledge on the inner side wall of the housing 1. The bi-metal strip 6 is connected to the connector terminal 7 through a contact strip 38 which holds an adjustment means 18 and is supported in the housing 1. As a result, the heat responsive bending of the bi-metal strip 6 in an outward direction causes substantially the same release operation as described above with reference to the electromagnetic rapid release means 3 except that now the pivoting of the release lever 10 takes place slowly since the motion of the bi-metal strip is transmitted to the release lever 10 by the slide bail 19. The precise point of time for the release may be adjusted in a simple manner from the outside of the housing 1 by means of a respective adjustment of the adjusting device 18. In order to prevent a faulty rapid release by the electromagnetic release means 3 during the slower temperature responsive release, there is provided an access opening 42 in the insulating housing 1 of the circuit breaker whereby the rear end of the upper guide plate 26, which simultaneously forms the pronged contact 4, may be electrically contacted to by-pass the energizing coil 37 of the electromagnetic release means 3. The access opening 42 is located in the housing 1 above the expansion space 28 of the arc chamber and the upper arc guide plate 26 of the sheet metal quenching stack 20 reaches all the way to a point below said access opening 42 thereby providing for a direct electrical contact with the fixed contact 4 of the circuit breaker means.

During the above described release operations, a high current arc is produced as a result of the instantaneous interruption of the circuit breaker means, that is, an interruption between the fixed contact 4 and the opening pivot contact 5. The magnetic field which is caused by the current loop including the electrical lead-in conductors and their contact members, drives the arc in the direction toward the quenching sheet metal stack 20. As a result, one end of the arc column travels along the pivot contact 5 toward the lower guide plate 25 of the quenching stack 20 whereas the other end of the arc column travels around the pronged protruding fixed contact 4 and onto the upper guide plate 26 also in the direction toward the quenching stack 20. When the first mentioned end point of the arc column reaches the lower guide plate 25, the full length of the arc will impinge upon the facing end 29 of the quenching stack 20, whereby the arc is subdivided into a plurality of partial arcs. These partial arcs are cooled down and de-ionized as they travel through the quenching stack 20 whereby the air volume, which is driven in front of the arcs, may first escape into the expansion space 28 whereupon the gases generated by the arc may follow the displaced air into the expansion space 28 from which the air and the gases may escape through a slot aperture 30 in the wall of the insulating housing 1 and thus into the atmosphere. For this purpose the channels between adjacent sheet metal strips of the quenching stack 20 have openings connecting these channels to said space 28. Thereafter the circuit breaker means and its quenching device are again ready for a renewed switching on and switching off operation.

The facing end of each sheet metal strip or plate 34 is provided with a Y-gap. All the gaps are aligned in the stack 20 to facilitate the arc quenching. A snap fastener 40 having a holding tongue 41 is secured to the outside of the housing 1.

Advantages of the specific structural combination of elements will now be described. Thus, it is an advantage of the invention that the above described spring mechanism 45 comprises essentially only two levers, namely, the cocking lever 9 and the release lever 10. Both levers are rotatable or rather tiltable about said common journal axis 11, whereby frictional forces and inertia moments are reduced to a minimum, especially because translatory motion, as distinguished from rotational motion, is substantially avoided. Such low frictional forces and inertia moments are rather advantageous with regard to the time sequence of the circuit breaking operation. Furthermore, the precise coordination of the intermeshing levers 9, 10 with the other elements of the spring mechanism 45 and with the circuit breaking device, makes the respective elements substantially independent of tolerances. In other words, the present invention has the advantage that close tolerances need not be maintained.

Incidentally, the wire bail 13 is supported in toggle joint fashion in the round end 21 of the actuating handle 2. The tension spring 14 is connected between a fixed point and said wire bail 13 and it is cocked during the switching on to guide the wire bail 13 along the slant 33 of the cocking lever 9 into a latching notch of the release lever 10, whereby the spring holds the wire bail in said latching notch. Thus, said narrow wire bail 13 slides into the latching notch of one of said levers, thereby providing a coupling along a line with the other lever. This feature of the invention assures on the one hand a relatively small friction coefficient in both directions of motion and on the other hand, it provides a very short unlatching motion or distance due to the functional co-operation of the two levers 9, 10.

The coupling between the centrally located pair of levers 9, 10 and the electrical switching means, especially the pivot contact 5 is accomplished by said guide bail 16, one end of which is journaled to the pivot contact in the contact area proper, that is opposite the stationary contact 4. The other, free end of the guide bail 16 slides in a groove of the cocking lever 9. Since the guide bail 16 extends centrally through a compression spring 15, which is held between the cocking lever 9, and the pivot contact 5, as described above, a definite guide is provided for the compression spring 15. The boss 17 protruding from the inner surface of the housing 1 adjacent to the compression spring 15 assures that the tipping of the spring about its center axis takes place in an instantaneous and limited manner as the spring 15 slides past the boss 17. The guide bail 16 prevents the compression spring from escaping in an uncontrolled manner in a lateral direction. This feature has the advantage that the entire cocking force is effective for the actuation of the pivot contact 5. Thus, the pivot contact 5 is caused to instantaneously pivot toward the fixed contact when the pressure applied by the cocking lever 9 reaches a certain point. Thereafter, the cocked spring 15 assures the required contact pressure at the point of contact. When the circuit breaker is switched off, the two levers 9, 10 and the compression spring 15 are released after the unlatching of the spring mechanism 45 whereupon the compression spring 15 tips about its longitudinal axis back into its normal position as it slides past said boss 17 in the housing during the course of the spring release. It is a special advantage of the invention that in the course of the just described unlatching operation, the contact pressure which is effective when the circuit breaker is in the on-condition, is instantaneously converted into a contact separating force which is contrary to prior art arrangements of this type. As a result, the pivot contact 5 is rapidly separated from the stationary contact 4 and the entire spring mechanism 45 is returned into its starting position, whereby the simultaneous dynamic impinging of the other leg of the cocking lever 9 on the pivot contact 5 opposes advantageously any possible fusing of the contact points.

The above described feature of the invention that one of the legs of the release lever 10 is located directly in front of the strike armature 22 of the electromagnetic unlatching means 3, when the spring mechanism is in the switched on condition assures an instantaneous transmittal of the contact breaking force through the release lever and the cocking lever onto the pivot contact 5. Simultaneously, said one leg of the release lever is operatively connected to the bi-metal strip 6 of the electro-thermo release device by means of the slide bail 19 which is guided on the side wall of the housing 1. Said bi-metal strip 6 is located behind, that is to the right of the pivot contact 5. Thus, the unlatching or release is made effective instantaneously in response to a short circuit and somewhat slower in response to an overload condition actuating the bi-metal strip 6. The release emanates in both instances from the same point of the release or unlatching lever 10. As a result, the pivot contact 5 tilts, in case of a short circuit, even independently of the spring mechanism into the open, circuit breaking position because the strike armature 22 and the respective lever leg directly hits the pivot contact 5.

The single arm pivot contact 5 is arranged in the space between the bi-metal strip 6 and the arc quenching chamber 39. The lower end of the pivot contact 5 is movably supported in the area of the lower arc guide plate 25 of the quenching sheet metal stack 20. The arc guide plate 25 has an extension forming a pivot bearing 27 for the pivot contact 5. The pivot bearing 27 for the pivot contact 5 may directly reach through a hole in the extension of the arc guide plate 25 and in electrical contact therewith. In an alternative embodiment the bearing for the pivot contact 5 may be provided in an insulated manner, whereby the lower end of the pivot contact rests on an insulated member supported by said extension of the arc guide 25. In a still further embodiment, the lower end of the pivot contact 5 may rest in a notch formed in the insulating material of the housing 1 and adjacent to the arc guide plate extension. The bi-metal strip 6 is electrically connected with the pivot contact 5 as well as with the lower arc guide plate 25 by means of a continuous, flexible stranded wire 24. In the alternative, where the pivot contact is supported in an insulated manner, the guide plate may be separately electrically connected to the respective connecting terminal 7 of the automatic circuit breaker. In this manner, the current through the pivot contact 5 is supplied directly at the point of contact with the stationary contact 4. Simultaneously, the electrical bridging of the bearing point 27 of the pivot contact 5 on the guide plate or the electrical bridging of the insulated bearing point of the pivot contact 5, prevents damage to the support or bearing of the pivot contact 5 by the switching arc, which runs off of the opened contact break distance 36 into the quenching chamber 39 and into the quenching stack 20.

As described, the fixed contact 4 is electrically, directly connected to the respective terminal 8 by means of the extended arc guide plate 26. The stationary contact 4 is formed into a prong constituting an extension of the upper arc guide plate 26. The other electrical connection is provided by the flexible, stranded wire 24 connected directly to a contact point of the movable pivot contact 5 which is located opposite the stationary contact 4. Such direct electrical connections to the contact points proper of the circuit breaker means has the advantage that a magnetic field is established at this point which tends to drive the arc, occurring as a result of a contact separation, in the direction toward the quenching stack 20. In this manner, the two starting points of the arc are moved by a magnetic drive force simultaneously along the stationary contact 4 of the upper arc guide plate 26 and along the pivot contact 5. When the arc column arrives in front of the quenching stack 20, the magnetic field of the latter will further enhance the pulling of the arc into the stack 20, whereby the arc is divided into several partial arcs, which is turn causes a high arc voltage. The high arc voltage substantially limits the arc current whereby the arc itself is rapidly quenched.

To further facilitate the rapid quenching, the rear side of the quenching stack 20 is provided with passageways which facilitate the pressure equalization of the generated arc gases into the adjacent expansion space 28 in the circuit breaker housing 1. The side wall of the housing is provided with slotted opening means 30 so that the expansion chamber may communicate with the atmosphere to further facilitate the pressure equalization. This feature has the advantage that the arc may travel at high speed through the entire quenching stack 20 toward the expansion space 28 without being impeded by any air volume which otherwise would accumulate at the end of the arc chamber toward which the arc drives the air.

In order to achieve a very compact structure, the electromagnetic release means 3 are located adjacent to the lever pair 9, 10, as well as directly between the actuating handle 2 and the arc chamber 39. The lever pair 9, 10 in turn is located above the electrical circuit breaker means 4, 5 and the bi-metal strip 6. The energizing coil 37 of the electromagnetic release means 3 is electrically connected with the stationary contact 4 of the cicuit breaker means, as well as with the connector terminal 8 of the automatic circuit breaker. The other connector terminal 7 of the automatic circuit breaker is employed to hold the bi-metal strip 6 inside the housing. Simultaneously, the other connector terminal 7 is provided with said adjustment means 18 for the adjusting of the desired release time. The adjustment means is accessible from the outside of the housing 1.

Due to the just summarized arrangment of the circuit breaker elements relative to each other, substantial space is saved in the lower portion of the circuit breaker housing for the circuit breaker contacts 4, 5 proper and for the arc quenching stack 20. This is so because the actuating handle 2 is arranged in the upper portion immediately above the electro-magnetic release means 3 and because the handle 2 and the release means 3 are arranged directly adjacent to the spring mechanism 45 which is actuated by these two members, namely, the handle 2 and the electromagnetic release means 3. Due to this gain in space, it is now possible to design such a switch in an advantageous manner either for a substantially higher circuit breaker rating while using a housing of conventional size, or to make the circuit breaker substantially smaller while maintaining the circuit breaker power rating equal to that of larger conventional circuit breakers. Thus, the present electrical circuit breaker constitutes a substantial improvement compared to the prior art, with regard to its small dimensions as well as with regard to its high circuit breaking power rating.

Although the invention has been described with reference to specific example embodiments, it is to be understood, that it is intended to cover all modifications and equivalents within the scope of the appended claims.

What is claimed is:

1. A heavy duty automatic circuit breaker comprising a housing of insulating material and electrical connector terminals supported in said housing, actuating means operably supported in said housing for manually operating said circuit breaker, a cocking and release mechanism arranged in said housing, contact means including a stationary contact member and a movable contact member arranged in said housing to form a circuit breaker path between said electrical connector terminals, arc quenching means arranged adjacent to said circuit breaker path in said housing, response means operatively arranged in said housing for cooperation with said actuating means, with said cocking and release mechanism and with said contact means, said movable contact member (5) comprising a single arm pivot contact, said stationary contact member (4) having a rear portion forming a first arc guide plate as part of said arc quenching means, a second arc guide plate also forming part of said arc quenching means, said second arc guide plate having an extension, pivot means on said extension of said second arc guide plate for supporting said single arm pivot contact at one end thereof, said single arm pivot contact having a free end opposite said one end, said free end being located substantially opposite said stationary contact member, and electrical connection means as part of said movable contact member, said electrical connection means being located substantially opposite said stationary contact member.

2. The circuit breaker according to claim 1, wherein said cocking and release mechanism comprises a cocking lever and a release lever, a common journal axis for both levers located in said housing, said cocking lever having a first arm and a second arm, said actuating means comprising a wire bail operatively interconnecting said first arm of said cocking lever and said actuating means, compression spring means operatively arranged to provide a force transmitting connection between said movable contact member and said first arm of said cocking lever, said second arm of said cocking lever being arranged for instantaneous cooperation with said movable contact member in response to a breaker release operation, said release lever also having a first arm and a second arm, said first arm of said release lever comprising a latching member arranged for engagement with said wire bail, said response means comprising means for separating said stationary and said movable contact members to open said circuit breaker path, said means for separating being arranged for cooperation with said second arm of said release lever.

3. The circuit breaker according to claim 2, wherein said cocking lever and said release lever are arranged to form a cooperating pair whereby one of said levers is provided with a groove and the other of said levers is held in said groove.

4. The circuit breaker according to claim 3, wherein said groove has a wall forming a stop for said other lever, said cocking and release mechanism further including cocking spring means located about said common journal axis and arranged to urge said cocking lever and said release lever toward each other, said housing comprising a stop means, said cocking lever having a projection arranged for cooperation with said stop means in response to the action of said compression spring means whereby the entire cocking and release mechanism is urged against said stop means.

5. The circuit breaker according to claim 2, wherein said actuating means comprise a handle member having a substantially round end journaled in said housing, said wire bail means being connected to said round end in toggle fashion, said cocking lever having a projecting, slanted guide member, said release lever having a latching member arranged adjacent to said slanted guide member and engaged by said wire bail, said actuating means further comprising tension spring means connected to said wire bail and partially looping around said round end of said handle member for urging said wire bail into guiding contact with said slanted guide member of said cocking lever and into latching contact with said latching member of the release lever.

6. The circuit breaker according to claim 2, further comprising guide bail means extending longitudinally through said compression spring means arranged between said single arm pivot contact which has a contact area and said cocking lever, journal means connecting one end of said guide bail means to said single arm pivot contact adjacent said contact area, said cocking lever having groove means in which the other end of said guide bail means is freely movable, said housing further comprising an inwardly protruding stud adjacent to said compression spring means, said stud being so positioned as to cause and limit the toggling of said compression spring means as the latter moves past the stud.

7. The circuit breaker according to claim 2, wherein said means for separating comprise electromagnetic means including a strike armature supported in said housing in such a position as to strike said second arm of said release lever, and temperature responsive means also supported in said housing, as well as a slide bail glidingly supported in said housing and operatively interconnecting said second arm of said release lever and said temperature responsive means.

8. The circuit breaker according to claim 1, wherein said single arm pivot contact is arranged in said housing substantially opposite said arc quenching means to form an arc chamber, said response means comprising a temperature responsive member arranged in said housing adjacent to said single arm pivot contact so that the latter is located between said arc chamber and said temperature responsive member, and, said circuit breaker further comprising flexible electrical conductor means conductively interconnecting said temperature responsive member, said single arm pivot contact, and said extension of said second arc guide plate.

9. The circuit breaker according to claim 1, wherein said pivot means for said single arm pivot contact support the latter in said housing in an insulating manner, said responsive means comprising a temperature responsive member arranged in said housing adjacent to said single arm pivot contact, said circuit breaker further comprising flexible electrical conductor means conductively interconnecting one of said connector terminals, said temperature responsive member, said single arm pivot contact, and said second arc guide plate of the arc quenching means.

10. The circuit breaker according to claim 1, further comprising first electrical conductor means conductively connecting said stationary contact member and one of said connector terminals whereby said first mentioned arc guide plate forms part of said electrical conductor means, and second electrical conductor means conductively connecting said single arm pivot contact to the other of said connector terminals at a point directly opposite said fixed contact member.

11. The circuit breaker according to claim 10, wherein said stationary contact member forms a protruding prong of said first arc guide plate.

12. The circuit breaker according to claim 1, wherein said response means comprise electromagnetic overload responsive circuit breaking means and temperature responsive circuit breaking means, said electromagnetic overload responsive circuit breaking means being located in said housing directly intermediate said arc quenching means and said actuating means as well as adjacent to said cocking and release mechanism, wherein the latter is located in said housing above said contact means and above said temperature responsive circuit breaking means, said electromagnetic overload responsive circuit breaking means comprising an energizing coil means connected at one end thereof to said stationary contact member, and with the other end to one of said electrical connector terminals.

13. The circuit breaker according to claim 1, wherein said response means comprise temperature responsive circuit breaker means including holding means securing said temperature responsive circuit breaker means inside said insulating housing, said circuit breaker further comprising adjusting means adjustably supported by said holding means in cooperating relationship with said temperature responsive circuit breaker means for adjusting the response characteristic of said temperature responsive circuit breaker means, said adjusting means being accessible outside of said housing, and means electrically connecting said holding means and said temperature responsive circuit breaker means to one of said electrical connector terminals.

14. The circuit breaker according to claim 1, wherein said arc quenching means comprise a stack of sheet metal plates, insulating spacer means spacing said plates from each other to form arc quenching channels extending longitudinaly through said stack, each of said sheet metal plates having an arc facing end with a Y-slot therein, said Y-slots being laterally aligned with each other and facing said movable contact member.

15. The circuit breaker according to claim 1, wherein said stationary contact member has a further portion forming an electrical connection terminal.

* * * * *